US006538662B2

(12) United States Patent
Moriarty

(10) Patent No.: US 6,538,662 B2
(45) **Date of Patent: *Mar. 25, 2003**

(54) EFFICIENT PIXEL PACKING

(75) Inventor: Michael P. Moriarty, Spring, TX (US)

(73) Assignee: Duke University, Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/862,510

(22) Filed: May 23, 2001

(65) Prior Publication Data

US 2002/0015045 A1 Feb. 7, 2002

Related U.S. Application Data

(63) Continuation of application No. 09/183,912, filed on Oct. 31, 1998, now Pat. No. 6,271,867.

(51) Int. Cl.[7] ..... G06G 5/36

(52) U.S. Cl. ..... 345/605; 345/549; 345/545

(58) Field of Search ..... 345/530, 545, 345/605, 600, 619, 643, 561, 501

(56) References Cited

U.S. PATENT DOCUMENTS

| | | | | |
|---|---|---|---|---|
| 5,696,945 | A | 12/1997 | Seiler et al. | 345/509 |
| 5,742,298 | A | 4/1998 | Bril et al. | 345/501 |
| 5,812,147 | A | 9/1998 | Hook et al. | 345/511 |

*Primary Examiner*—Kee M. Tung
(74) *Attorney, Agent, or Firm*—Fleshner & Kim, LLP

(57) ABSTRACT

In storing data for display, traditionally twenty-four bit video pixels have required extra video memory to store the video pixels on double word boundaries or extensive hardware to fully utilize video memory. Eight twenty-four bit video pixels are stored within three quad words in a manner that reduces the required hardware from prior approaches and fully utilizes video memory.

33 Claims, 11 Drawing Sheets

| | DATA(63:40) | DATA(39:32) | DATA(31:8) | DATA(7:0) |
|---|---|---|---|---|
| ADDRESS 0 | (RGB2) | R3 | (RGB1) | G3 |
| ADDRESS 1 | (RGB5) | R6 | (RGB4) | B3 |
| ADDRESS 2 | (RGB8) | G6 | (RGB7) | B6 |

| | DATA(63:40) | DATA(39:32) | DATA(31:8) | DATA(7:0) |
|---|---|---|---|---|
| ADDRESS 0 | (RGB2) | R3 | (RGB1) | G3 |
| ADDRESS 1 | (RGB5) | R6 | (RGB4) | B3 |
| ADDRESS 2 | (RGB8) | G6 | (RGB7) | B6 |

FIG. 5

| | DATA(63:48) | DATA(47:32) | DATA(31:16) | DATA(15:0) |
|---|---|---|---|---|
| ADDRESS 0 | (RGB4) | (RGB3) | (RGB2) | (RGB1) |
| ADDRESS 1 | (RGB8) | (RGB7) | (RGB6) | (RGB5) |
| ADDRESS 2 | (RGB12) | (RGB11) | (RGB10) | (RGB9) |

FIG. 6

EFFICIENT PIXEL PACKING

CROSS-REFERENCE TO RELATED APPLICATIONS

This application is a continuation of application Ser. No. 09/183,912, filed Oct. 31, 1998, now U.S. Pat. No. 6,271,867.

BACKGROUND OF THE INVENTION

1. Field of the Invention

This invention relates to storing pixel data in video memory and more specifically to storing eight twenty-four bit pixels within three quad words of video memory.

2. Description of the Related Art

The amount of video memory required to hold an image depends on the resolution of the image and color depth used per pixel. To display a true color image generally uses twenty-four bits of data per pixel. The twenty-four bits that make-up a true color pixel include eight bits for each of a red, green, and blue (RGB) signal. Most addressing schemes address video memory eight, sixteen, or thirty-two bits at a time.

Traditionally, when twenty-four bit pixel data was stored in video memory (that was addressed thirty-two bits at a time) eight bits of video memory per pixel were unused. This was because it was desirable (to avoid the addition of hardware to reorient the pixel data) to store the twenty-four bit pixel data on a double word boundary. In an effort to fully utilize video memory, various schemes were devised which allowed data for an individual pixel to possibly be stored in a different double word (thirty-two bits) within video memory. One such scheme stored twenty-four bit RBG pixel data sequentially in video memory. Utilizing this scheme, a twenty-four bit RGB pixel was stored on an upper and lower boundary of every three double words (ninety-six bits) of video memory. This scheme required the implementation of extensive hardware to reorient the RGB pixel data when read from video memory, before display.

SUMMARY OF THE INVENTION

A system according to the present invention provides a technique that efficiently packs eight twenty-four bit pixels into three quad words of video memory. This is accomplished by dividing two of the eight twenty-four bit pixels into constituent eight bit representations of each of three primary pixel colors. Two undivided pixels and two of the constituent eight bit representations of the divided pixels are stored within each of the quad words. In one embodiment, each of the two undivided pixels is stored on a double word boundary.

An advantage of the disclosed embodiment is that it simplifies the hardware required to reorient the pixel data, before display, while maintaining efficient packing of twenty-four bit pixel data.

BRIEF DESCRIPTION OF THE DRAWINGS

A better understanding of the present invention can be obtained when the following detailed description of the preferred embodiment is considered in conjunction with the following drawings, in which:

FIG. 5 illustrates the storage of eight (twenty-four bit) pixels in three quad words of video memory according to an embodiment of the present invention;

FIG. 6 illustrates the storage of twelve (16 bit) pixels in three quad words of video memory according to an embodiment of the present invention;

DETAILED DESCRIPTION OF INVENTION

The present invention provides a technique that efficiently packs eight twenty-four bit pixels into three quad words of video memory. This is accomplished by dividing two of the eight twenty-four bit pixels into constituent eight bit representations of each of three primary pixel colors. Two undivided pixels and two of the constituent eight bit representations of the divided pixels are stored within each of the quad words. In one embodiment, each of the two undivided pixels is stored on a double word boundary of each of the quad words.

Display/Display Controller

Figure 1:
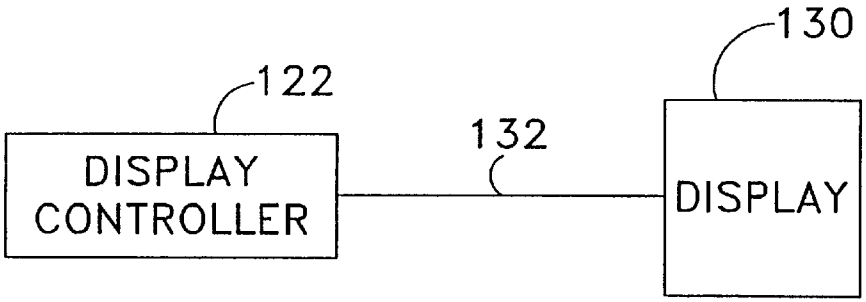
FIG. 1 illustrates a display controller coupled to a display according to an embodiment of the present invention.

FIG. 1 depicts a display controller 122 coupled to a display 130 by a bus 132. The bus 132 is an eight, sixteen, or thirty-two bit bus or otherwise. The display 130, in the preferred embodiment, is a liquid crystal display (LCD). The display controller 122 supplies pixel data to the display screen 131 (see FIGS. 2A and 2B). While the display controller 122 is depicted separately from the display 130 in FIG. 1, in the preferred embodiment the display controller 122 is incorporated within the display 130 (see FIG. 2B).

Figure 2B:
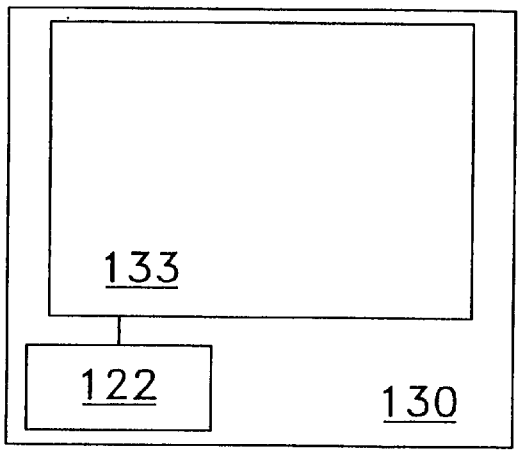
FIG. 2B illustrates a display controller incorporated within a display according to an embodiment of the present invention.
Figure 2A:
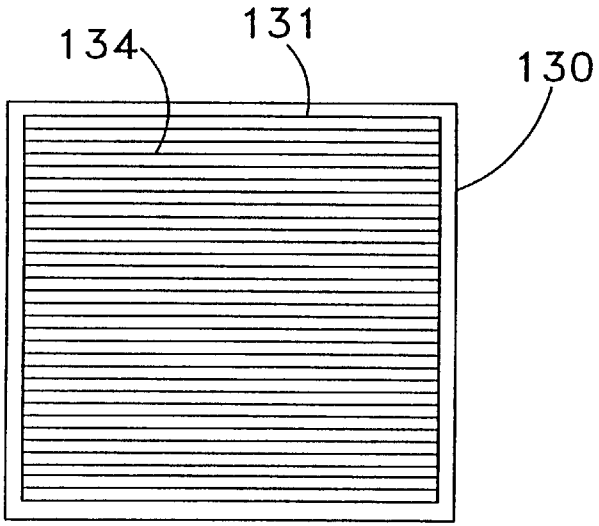
FIG. 2A illustrates a display and display screen according to an embodiment of the present invention.

Moving to FIG. 2A, a display screen 131 of the display 130 is further illustrated. Similar to a cathode ray tube (CRT), an LCD is normally considered to consist of a number of lines 134. For example, a monochrome 1280× 1024 LCD display screen includes 1024 lines and each line includes 1280 pixels (approximately 1.3 million cells). Updating the display screen at sixty frames per second results in each line being updated in less than 16.3 microseconds. FIG. 2B depicts the display controller 122 incorporated within the display 130. As before, the display controller 122 supplies pixel data to the display screen 131.

Figure 3:
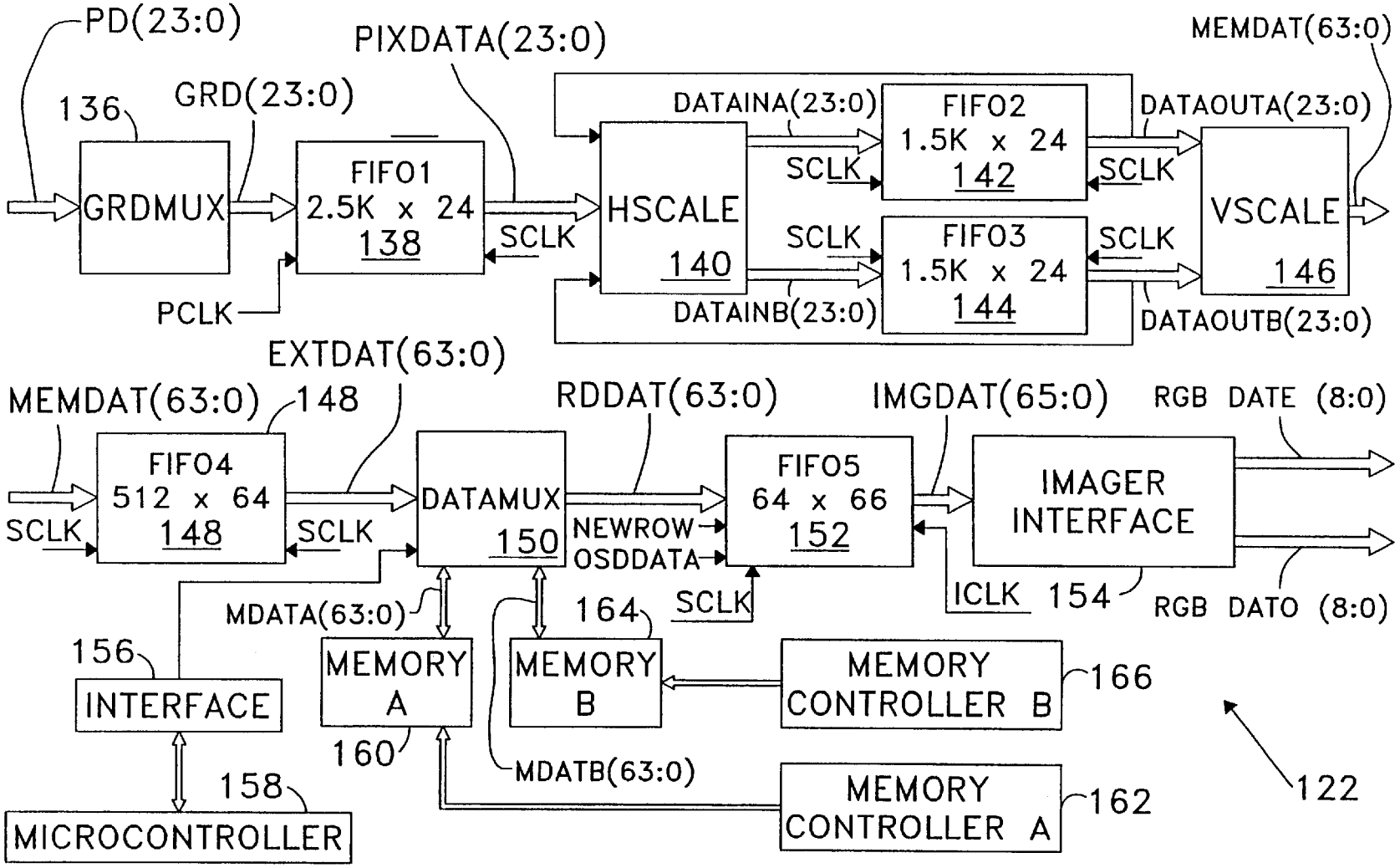
FIG. 3 further illustrates a display controller according to an embodiment of the present invention.

FIG. 3 illustrates the display controller 122 in greater detail. A graphics card 106 (see FIG. 5) provides pixel data (a RGB signal) to the display controller 122. In this embodiment, the pixel data originates from the graphics card 106 and is typically an analog signal. The display controller 122 employs a digital input signal. As such, the pixel data (RGB signal), if analog, is converted (not shown) to digital prior to being transmitted to the display controller 122. This pixel data (PD [23:0]) is initially fed to a multiplexer (GRDMUX) 136. The pixel data from the multiplexer 136 is coupled to a first-in first-out (FIFO) buffer (FIFO1) 138. The pixel data is clocked into the buffer 138 by a 110 MHz clock signal (PCLK). Pixel data is clocked out of the buffer 138 by a 92 MHz clock signal (SCLK).

The pixel data (PIXDATA [23:0]), which comes from the buffer 138, is coupled to a horizontal scale section 140. The display controller 122 includes support for horizontal resolutions of 1280, 1024, 800, 720, 704, 640, 512, 400, 360, and 320. Various control registers (not shown) on the display controller 122 enable an incoming image (the pixel data) to be scaled, if desired. Pixel data (DATAINA [23:0]) is coupled to a FIFO buffer (FIFO2) 142. Pixel data (DATAINB [23:0]) is coupled to a FIFO buffer (FIFO3) 144. This pixel data is clocked into the FIFO buffers 142 and 144 at the SCLK frequency. This pixel data is clocked out of the FIFO buffers 142 and 144 (at the SCLK frequency) and into a vertical scale section (VSCALE) 146 of the display controller 122.

If vertical scaling is enabled, the vertical scale section 146 scales the pixel data as set by certain registers (not shown). The scaled or non-scaled pixel data is then output as memory data MEMDAT [63:0]. The vertical scale section 146 also functions to reorient pixel data for efficient storage. MEMDAT[63:0] is a sixty-four bit signal which is coupled to a FIFO buffer (FIFO4) 148. That pixel data is clocked into the FIFO buffer 148 at the SCLK frequency. The pixel data is then clocked out of the FIFO buffer 148 and into a data multiplexer (DATAMUX) 150. The pixel data can then be routed through the data multiplexer 150 and into frame buffers (MEMORY A and MEMORY B) 160 and 164. The frame buffer 160 is controlled by a memory controller (MEMORY CONTROLLER A) 162. The frame buffer 164 is controlled by a memory controller (MEMORY CONTROLLER B) 166. The data multiplexer 150 also routes the pixel data (MDATA[63:0] and MDATB[63:0]) from the frame buffers 160 and 164 to a FIFO buffer (FIFO5) 152 (as RDDAT[63:0]). The pixel data (IMGDAT [65:0]) is clocked out of the FIFO buffer 152 by a 92 MHz clock signal (ICLK). The pixel data is then coupled to an imager interface 154. The imager interface 154 supplies pixel data (RGB DATE[8:0] and RGB DATO[8:0]) to the display 130. The imager interface 154 also functions to reorient pixel data for display.

Computer System

Figure 4:
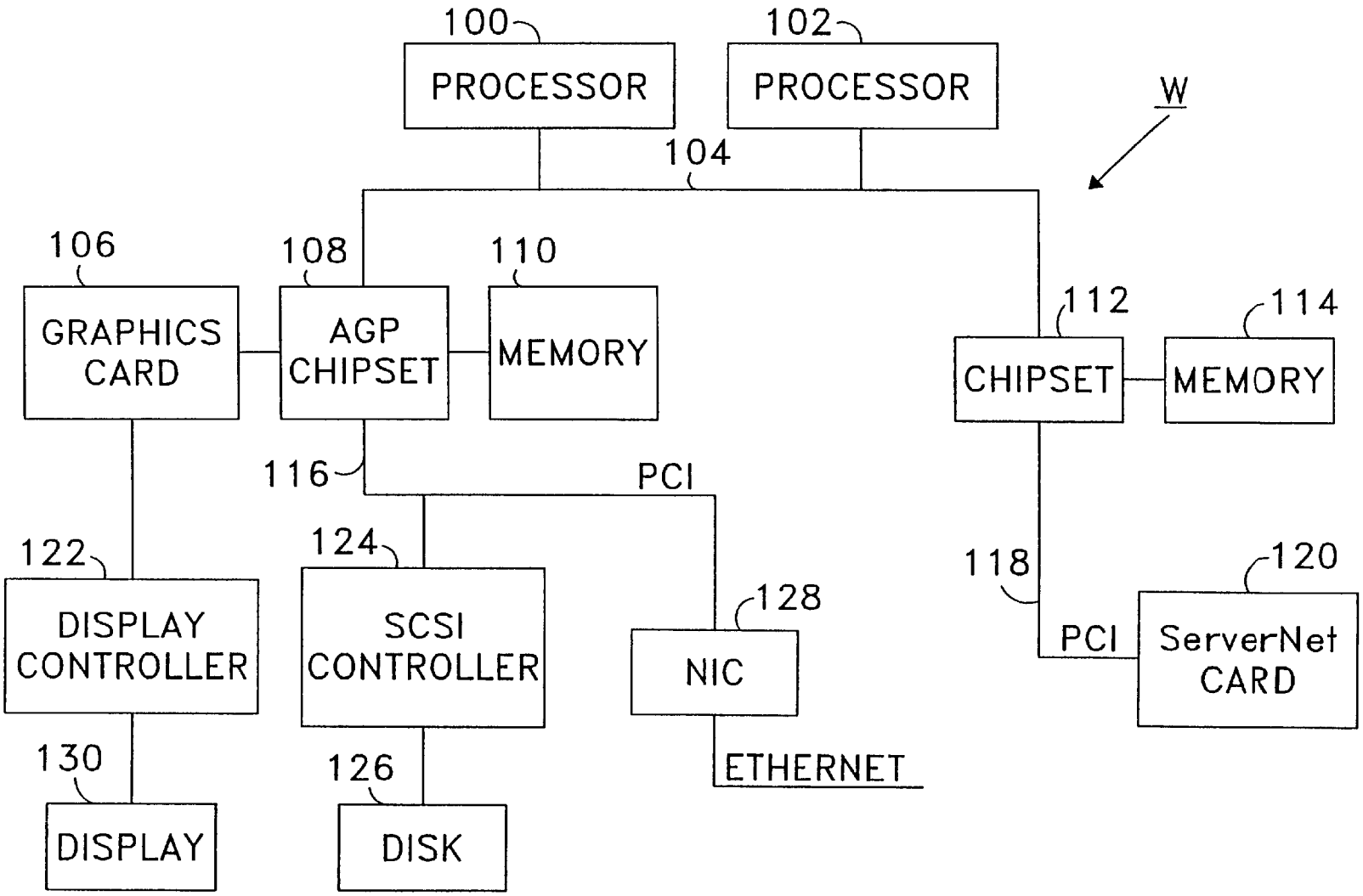
FIG. 4 is a block diagram of a workstation W that implements an embodiment of the present invention.

Turning to FIG. 4, illustrated is a block diagram of a workstation W according to an embodiment of the present invention. While a workstation is shown, it is contemplated that various other computer systems such as a personal computer or a mainframe could implement the present invention. Processors 100 and 102 are coupled to a host bus 104. The processors 100 and 102 in the preferred embodiment are Pentium II processors manufactured by the Intel Corporation. Also coupled to the host bus 104 is a chipset 108 and a chipset 112. The chipset 108 provides a memory controller for controlling memory 110, a host-PCI bus bridge for coupling a PCI bus 116 to the host bus 104, and an AGP connector for connecting a graphics card 106. The display controller 122 is coupled to the graphics card 106 and the display 130. The display 130, in one embodiment, is a liquid crystal display (LCD) used in projection-based imagers.

Coupled to the PCI bus 116 is a small computer system interface (SCSI) controller 124 and a network interface card (NIC) 128. The NIC 128 can provide an Ethernet connection for coupling the workstation W to a local area network (LAN). Coupled to the SCSI controller 124 is a disk subsystem 126. The SCSI controller 124 can potentially control various disk subsystems 126 which can include: tape drives, WORM, CD-ROM, DVD, and optical storage devices.

The chipset 112 provides a memory controller for controlling memory 114, and a host-PCI bus bridge for coupling a PCI bus 118 to the host bus 104. Coupled to the PCI bus 118 is a ServerNet card 120. The ServerNet card 120 can provide for a high speed communication link between multiple workstations.

The Pentium II processors 102 and 104 could be replaced with different processors other than the Pentium II without detracting from the spirit of the invention. The processors 102 and 104 are capable of running any of a number of operating systems, such as Windows 95®, Windows NT®, or a Unix based operating system.

Again, it should be understood that a wide variety of systems could be used instead of the disclosed workstation W without detracting from the spirit of the invention. Further, other current and future operating systems could also be utilized.

Pixel Packing

Turning to FIG. 5, depicted is a snap-shot of three quad words of red, green, and blue (RGB) pixel data as stored within video memory according to an embodiment of the present invention. The pixel data can be stored within either of two frame buffers (Frame1 or Frame2), which in the disclosed embodiment are located on the display controller 122. Moving to a first row of the video memory snap-shot (which corresponds to video memory address 0), a green portion of a third pixel (G3) is stored at data location [7:0]. A red portion of the third pixel (R3) is stored at data location [39:32]. A first pixel (RGB1) is stored at data location [31:8]. A second pixel RGB2) is stored at data location [63:40].

Moving to a second row of the memory snap-shot (which corresponds to video memory address 1) a blue portion of the third pixel (B3) is stored at data location [7:0]. A red portion of a sixth pixel (R6) is stored at data location [39:32]. A fourth pixel (RGB4) is stored at data location [31:8] and a fifth pixel (RGB5) is stored at data location [63:40].

Moving to a third row of the memory snap-shot (which corresponds to video memory address 2), a blue portion of the sixth pixel (B6) is stored in data location [7:0]. A green portion of the sixth pixel (G6) is stored at data location [39:32]. A seventh pixel (RGB7) is stored at data location [31:8] and an eighth pixel (RGB8) is stored at data location [63:40]. The above process is repeated (that is—every third pixel is partitioned) until a frame of pixel data has been stored within a frame buffer. This process is further illustrated in FIGS. 10 and 12.

FIG. 6 illustrates a snap-shot of video memory and how 'on screen display' (OSD) pixel data is stored within a frame buffer. The OSD allows for information display within a reduced portion of a display that utilizes a 1280×1024 display screen. The dimension of the OSD is 384×((16*n)+12), where n ranges from 0 to 18, and can be positioned horizontally within the 1280×1024 display screen. Each OSD pixel includes sixteen bits. The sixteen bits are made-up of five red bits, six green bits, and five blue bits. Since the data consists of sixteen bits, it can be sequentially stored such that four pixels fit within one quad word and twelve pixels fit within three quad words. As such extensive hardware is not required to reorient pixel data for storage within video memory or display.

Figure 7:
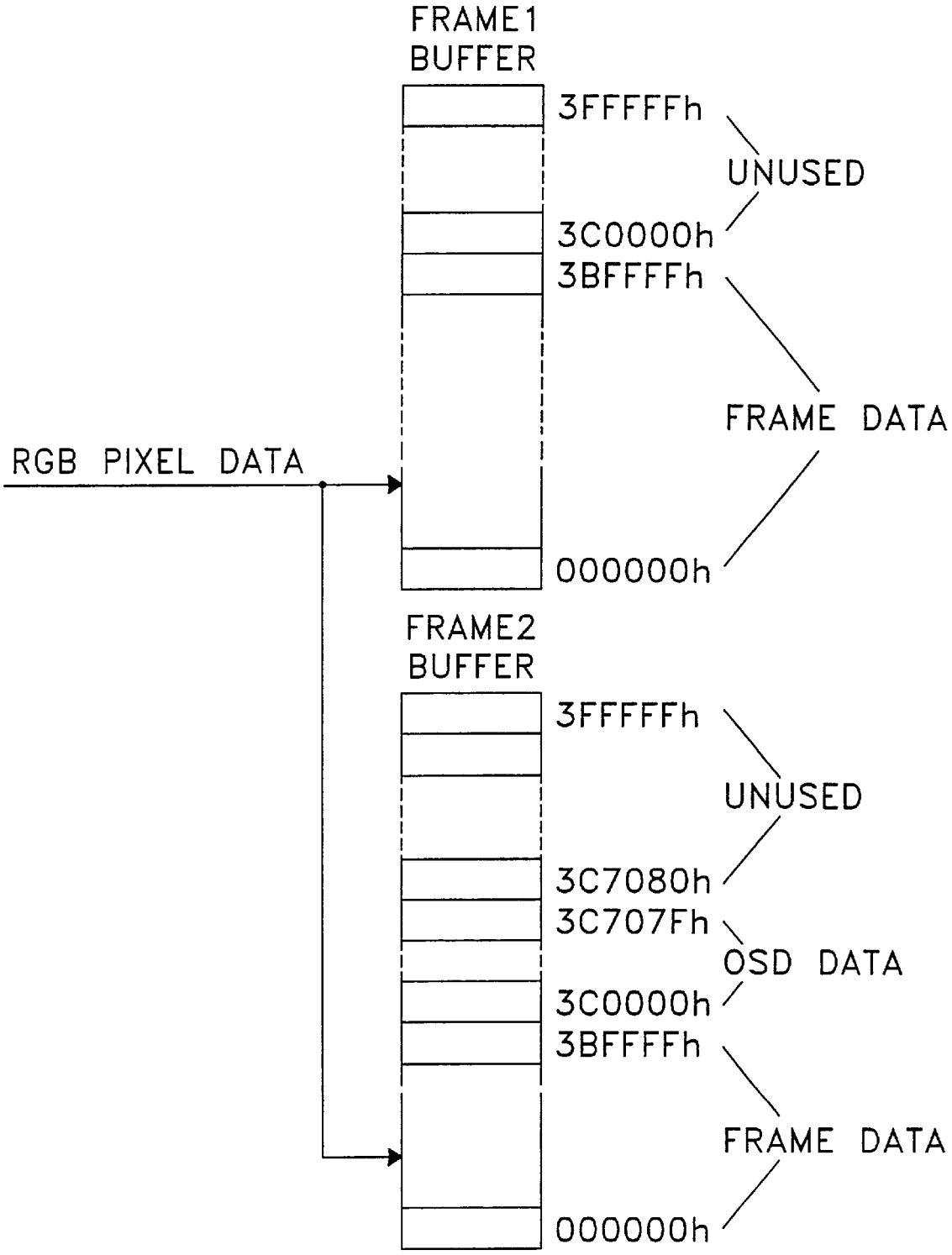
FIG. 7 illustrates addressing for frame buffers (video memory) of a display controller according to an embodiment of the present invention.

Turning to FIG. 7, illustrated are address locations of the frame buffers 160 and 164 (see FIG. 3) where red, green, and blue (RGB) pixel data is stored. In the disclosed embodiment, the frame buffers 160 and 164 are located on the display controller 122. Frame or pixel data for a normal display is alternatively stored within a Frame1 buffer and a Frame2 buffer at addresses 000000h through 3BFFFFh. OSD pixel data is stored within the Frame2 buffer at addresses 3C0000h through 3C707Fh. The OSD pixel data is routed from microcontroller 158 through an interface 156 to the data multiplexer 150 (see FIG. 3).

Figure 8:
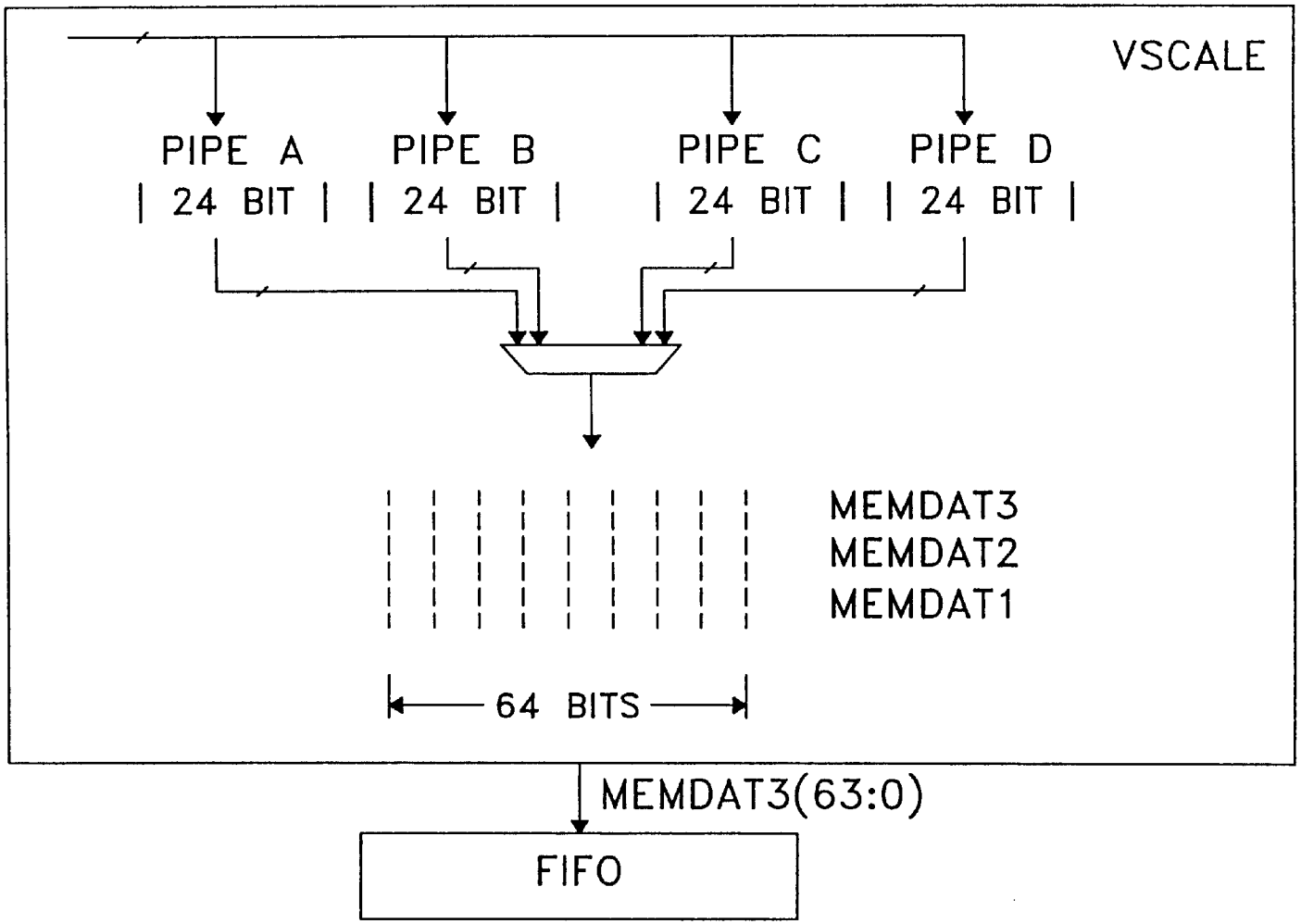
FIG. 8 depicts hardware located within a vertical scale section of the display controller that orients twenty-four bit RGB data for storage in video memory (frame buffer) according to an embodiment of the present invention.

Moving to FIG. 8, a portion of the vertical scale (VSCALE) section 146 (see FIG. 3) of the display controller 122 is illustrated. The pixel data is routed through four different pipes: Pipe A, Pipe B, Pipe C and Pipe D. Each of these pipes is twenty-four bits wide. These pipes are multiplexed such that pixel data can be stored in video (frame buffer) memory in accordance with FIG. 5. The pixel data is temporarily stored in registers as quad words (64 bits) MEMDAT1, MEMDAT2, and MEMDAT3. For timing reasons, that data is then fed through the buffer 148 (see FIG. 3) for storage within the Frame1 or Frame2 buffers (160 and 164).

Figure 9A:
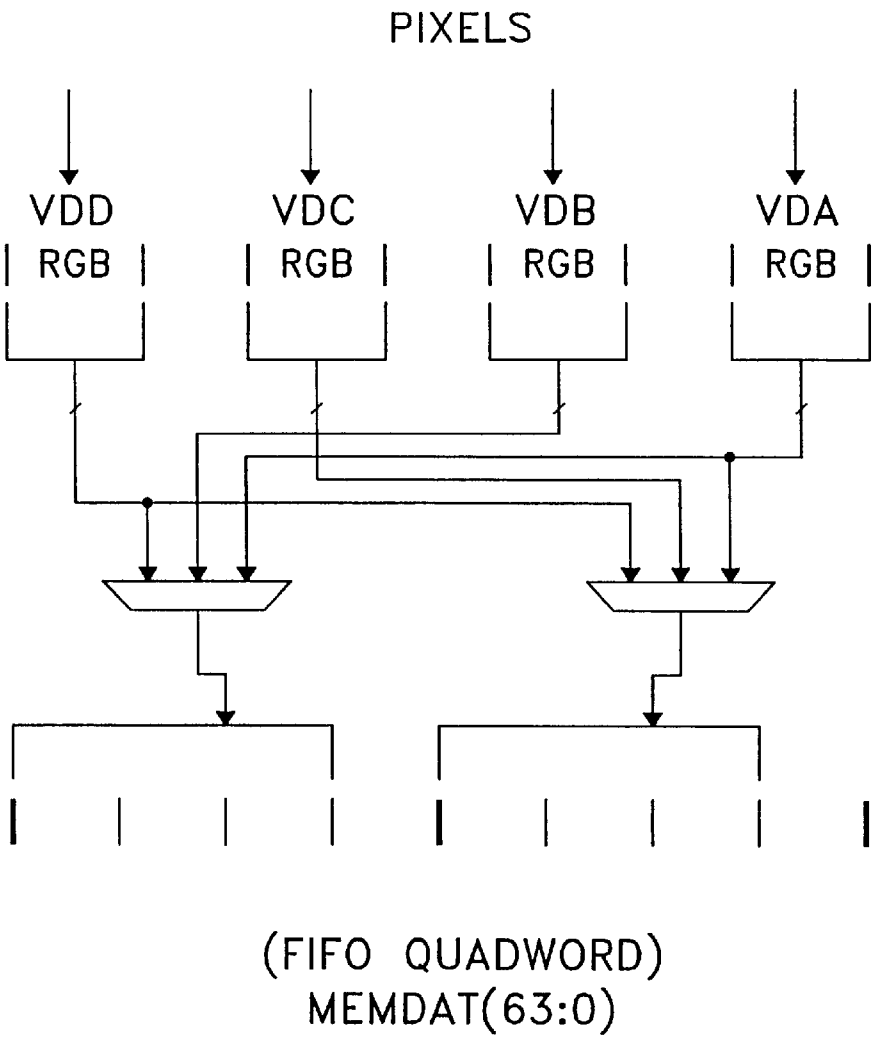
FIGS. 9A–9B depict the hardware of FIG. 8 in greater detail.

FIG. 9A further illustrates multiplexing that is performed on the various pixel pipes. The video data (VD) that is routed through Pipe A, Pipe B, Pipe C, and Pipe D is respectively denominated as VDA, VDB, VDC, and VDD. Referring now to the Verilog code of Appendix A: VDA corresponds to VDATREGA, VDB corresponds to VDATREGB, VDC corresponds to VDATREGC, and VDD corresponds to VDATREGD. Each of the VDA, VDB, VDC, and VDD are made up of twenty-four bit RGB pixel data. Returning to FIG. 9A, VDA is either stored on an upper boundary of an upper double word of a quad word or on an upper boundary of a lower double word of a quad word. When VDB is stored as a complete pixel, it is stored on an upper boundary of an upper double word of a quad word. When VDC is stored as a complete pixel, it is stored on an upper boundary of a lower double word of a quad word. VDD, like VDA, can be stored on an upper boundary of a lower double word or a higher double word of a quad word.

Figure 9B:
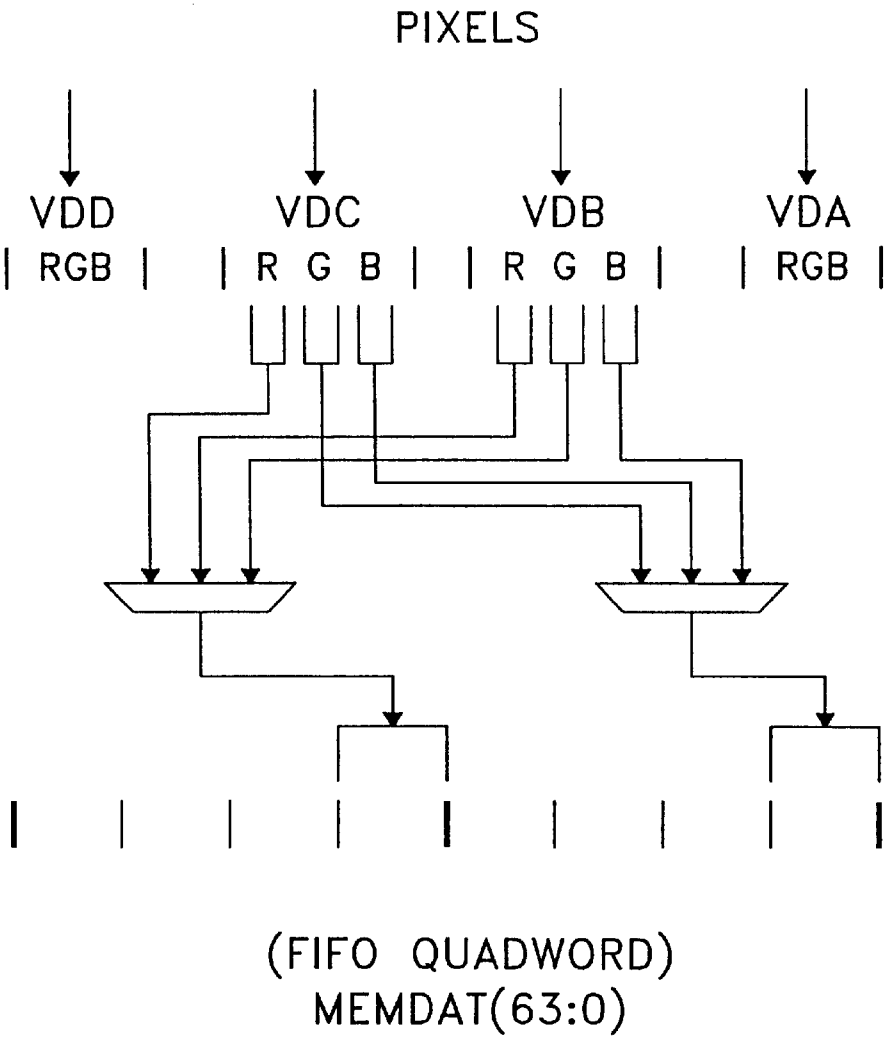

Turning to FIG. 9B illustrated is the multiplexing of pixels VDC and VDB. A blue portion of VDB and VDC are multiplexed to a lower byte of a lower double word of a quad word. Also multiplexed to a lower byte of a lower double word of a quad word is a green portion of VDC. The red and green portion of VDB are multiplexed to a lower byte of an upper double word of a quad word. Also multiplexed to a lower byte of an upper double word of a quad word is a red portion of VDC.

Figure 10:
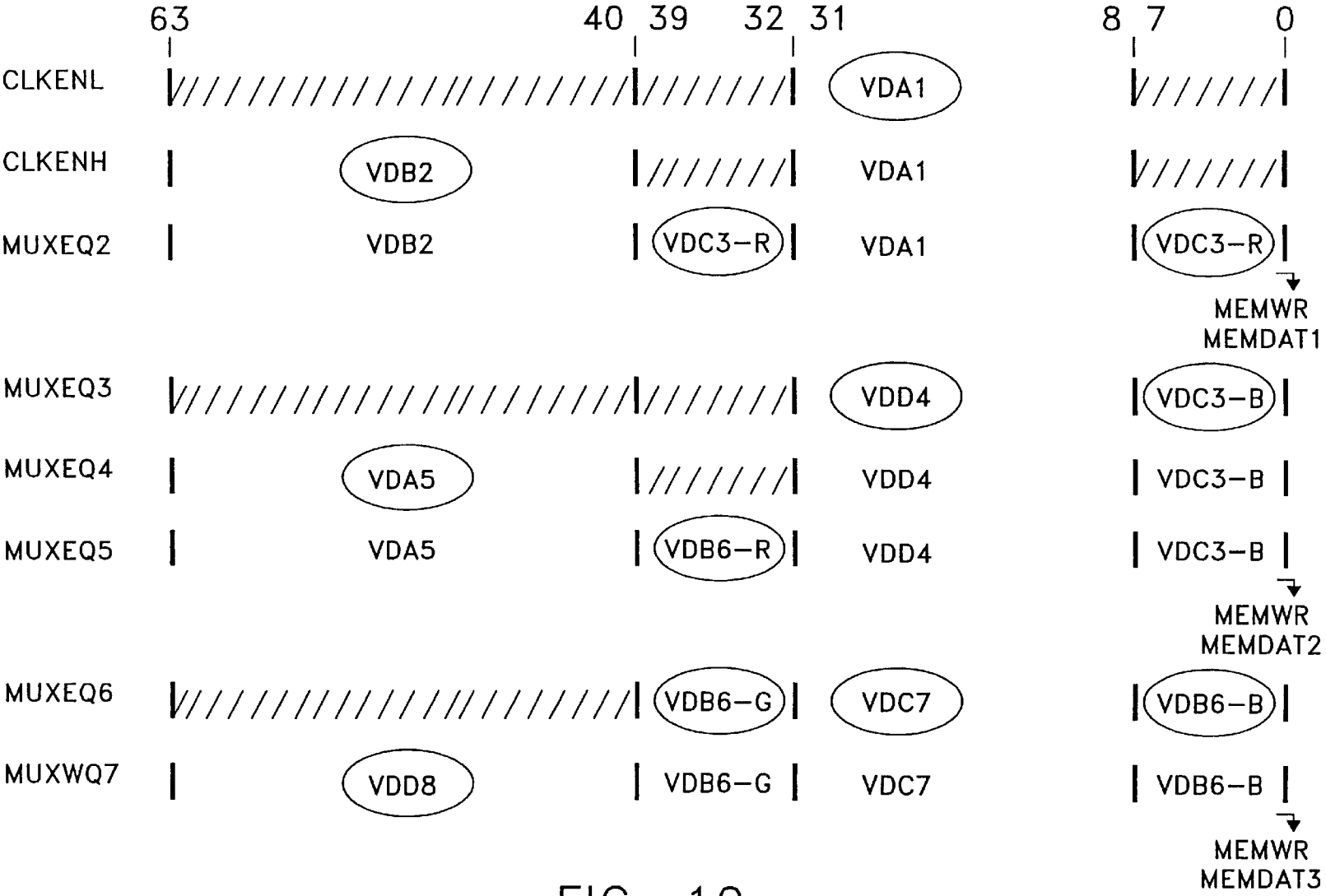
FIG. 10 illustrates the temporary storage of pixel data in registers prior to storage in video memory.

The temporary storage of pixels corresponding to VDA, VDB, VDC, and VDD is further illustrated in FIG. 10. When clock enable low (CLKENL) is asserted, VDA1 (a first pixel) is stored in registers corresponding to video memory location [8:31]. When clock enable high (CLKENH) is asserted, VDB2 (a second pixel) is stored in a register corresponding to video memory location [63:40]. When MUXEQ2 is asserted, VDC3-R (a red portion of a third pixel) is stored in a register corresponding to video memory location [32:39]. Also, VDC3-G (a green portion of the third pixel) is stored in a register corresponding to video memory location [0:7]. Upon receiving a MEMWR signal a quad word (MEMDAT1)is transferred to the FIFO buffer.

When MUXEQ3 is asserted, VDA4 (a fourth pixel) is stored in the register corresponding to the video memory location [8:31]. Also, VDC3-B (a blue portion of the third pixel) is stored in the register corresponding to the video memory location [0:7]. When MUXEQ4 is asserted, VDA5 (a fifth pixel) is stored in the register corresponding to the video memory locations [63:40]. When MUXEQ5 is asserted, VDB6-R (a red portion of a sixth pixel) is stored in the register corresponding to the video memory locations [39:32]. Upon receipt of a MEMWR signal, a quad word (MEMDAT2) is transferred to the FIFO buffer.

When MUXEQ6 is asserted, VDC7 (a seventh pixel) is stored in the register corresponding video memory locations [8:31]. Also, VDB6-B (a blue portion of the sixth pixel) is stored in the register corresponding to the video memory location [0:7] and VDB6-G (a green portion of the sixth pixel) is stored in the register corresponding to video memory locations [32:39]. When MUXEQ7 is asserted, VDD8 (an eighth pixel) is stored in the register corresponding to the video memory locations [40:63]. Upon receipt of a MEMWR signal, a quad word (MEMDAT3) is transferred to the FIFO buffer.

Figure 11:
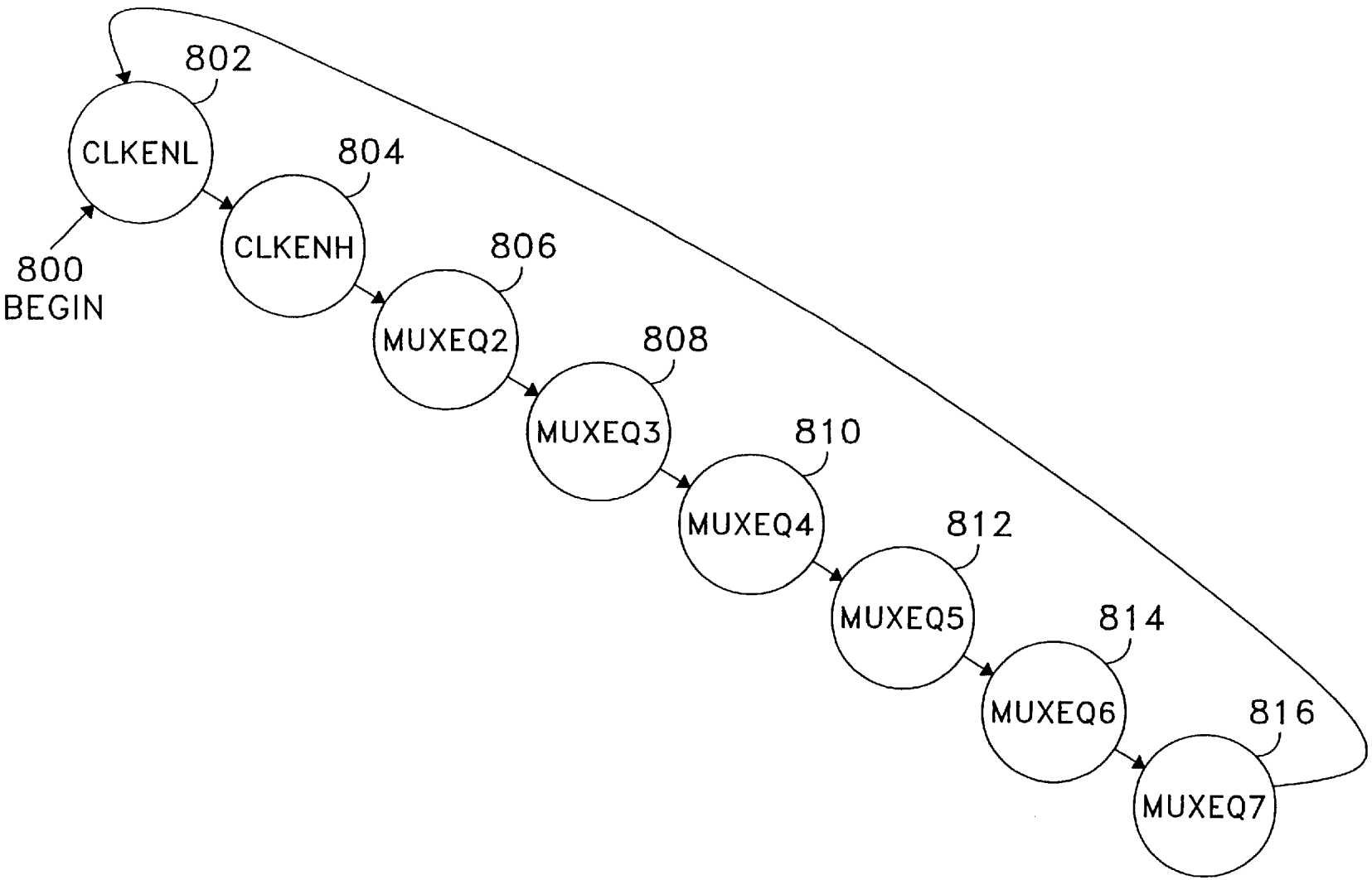
FIG. 11 is a state diagram associated with the storage of pixel data.

Turning to FIG. 11, the flow of FIG. 10 is further illustrated in a state machine. The state machine is entered through step 800. From step 800 control transfers to step 802. After CLKENL is asserted, control transfers to step 804. In step 804, after CLKENH is asserted, control transfers to the next state in step 806. In step 806, after MUXEQ2 is asserted, control transfers to step 808. In step 808, after MUXEQ3 is asserted control transfers to step 810. In step 810, after MUXEQ4 is asserted control transfers to step 812. In step 812, after MUXEQ5 is asserted control transfers to step 814. In step 814, after MUXEQ6 is asserted control transfers to step 816. In step 816, after MUXEQ is asserted control returns to step 802. Thus, when CLKENL is asserted again (in step 802) the flow of the state machine is repeated.

Figure 12:
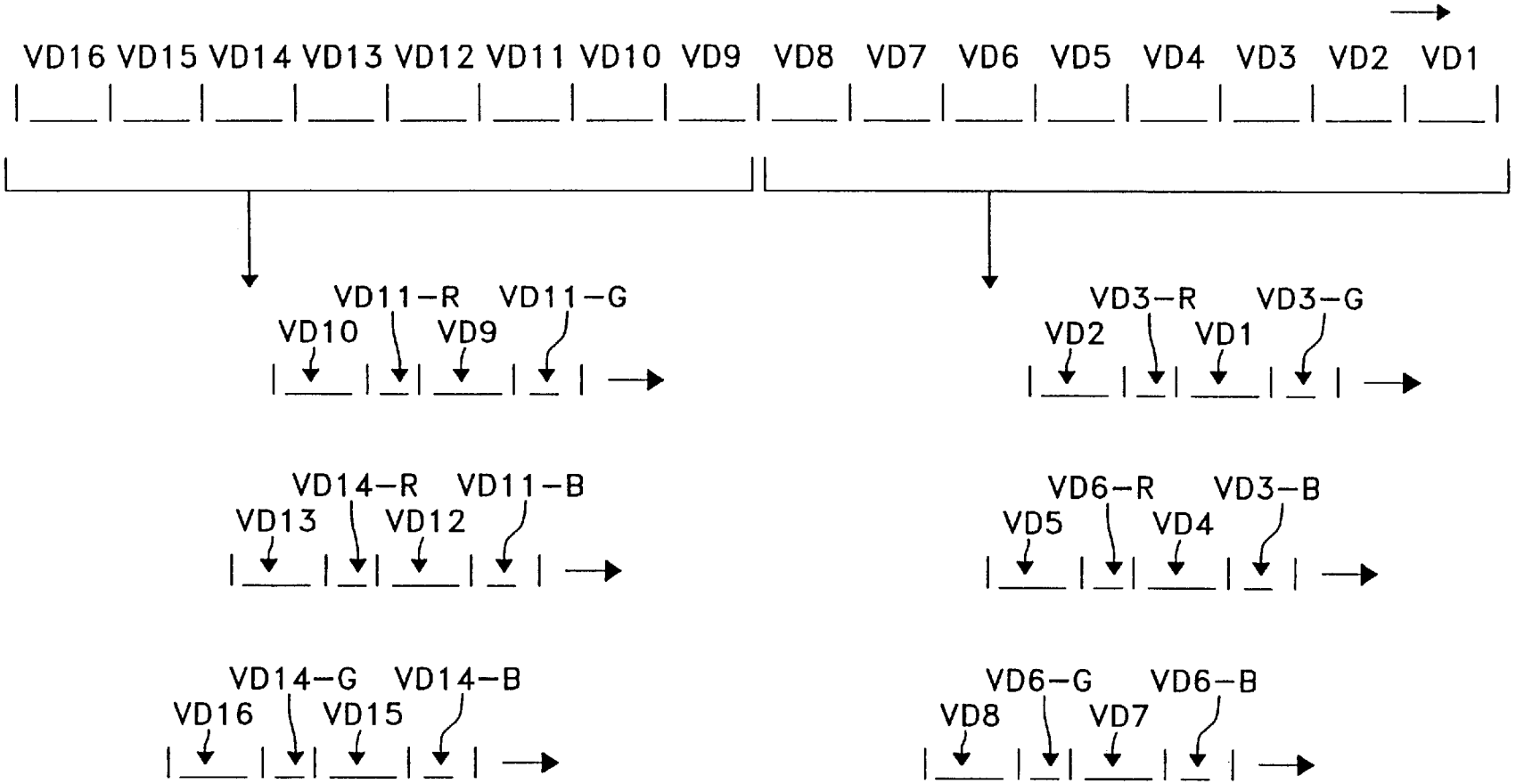
FIG. 12 is a diagram illustrating the storage of six quad words of pixel data in video memory.

FIG. 12 illustrates the sequencing of six quad words for storage within a frame buffer. Each video data (VD) represents a pixel and includes twenty-four bits of pixel data. Each of the primary colors, red, green, and blue (RGB), is made up of eight bits. A green portion of a third pixel (VD3-G) is stored in a register corresponding to a first byte of a first quad word. A first pixel (VD1) is stored on an upper boundary of a lower double word of the first quad word. A red portion of the third pixel (VD3-R) is stored in a lower byte of an upper double word of the first quad word. A second pixel (VD2) is stored on an upper boundary of the upper double word of the first quad word.

A blue portion of the third pixel (VD3-B) is stored in a lower byte of a second quad word. A fourth pixel (VD4) is stored on an upper boundary of a lower double word of the second quad word. A red portion of a sixth pixel (VD6-R) is stored as a lower byte of an upper double word of the second quad word. A fifth pixel (VD5) is stored on an upper boundary of the upper double word of the second quad word.

A blue portion of the sixth pixel (VD6-B) is stored as a lower byte of a third quad word. A seventh pixel (VD7) is stored on an upper boundary of a lower double word of the third quad word. A green portion of the sixth pixel (VD6-G) is stored as a lower byte of an upper double word of the third quad word. An eighth pixel (VD8) is stored on an upper boundary of the upper double word of the third quad word.

A green portion of an eleventh pixel (VD11-G) is stored in a register corresponding to a first byte of a first quad word. A ninth pixel (VD9) is stored on an upper boundary of a lower double word of the first quad word. A red portion of the eleventh pixel (VD11-R) is stored as a lower byte of an upper double word of the first quad word. A tenth pixel (VD10) is stored on an upper boundary of the upper double word of the first quad word.

A blue portion of the eleventh pixel (VD11-B) is stored as a lower byte of a second quad word. A twelfth pixel (VD12)

is stored on an upper boundary of a lower double word of the second quad word. A red portion of a fourteenth pixel (VD14-R) is stored as a lower byte of an upper double word of the second quad word. A thirteenth pixel (VD13) is stored on an upper boundary of the upper double word of the second quad word.

A blue portion of the fourteenth pixel (VD14-B) is stored as a lower byte of a third quad word. A fifteenth pixel (VD15) is stored on an upper boundary of a lower double word of the third quad word. A green portion of the fourteenth pixel (VD14-G) is stored as a lower byte of an upper double word of the third quad word. A sixteenth pixel (VD16) is stored on an upper boundary of the upper double word of the third quad word. Using the same technique, any remaining pixels are stored in registers and coupled to the appropriate frame buffer through the FIFO buffer.

An advantage of the disclosed embodiment is that it simplifies the hardware required to reorient the pixel data, before display, while maintaining efficient packing of twenty-four bit pixel data into video memory. In the disclosed embodiment, two 8-bit multiplexers and two 24-bit multiplexers perform all the routing necessary to pack eight 24-bit pixels into three 64-bit quad words. To "linearly" pack the pixels would typically employ a greater number of multiplexers.

The foregoing disclosure and description of the invention are illustrative and explanatory thereof, and various changes in the size, shape, materials, components, circuit elements, wiring connections and contacts, as well as in the details of the illustrated circuitry and construction and method of operation may be made without departing from the spirit of the invention.

APPENDIX A

```
/*****************************************************************************  */
/*                    VSCALE Module                                              */
/*   functional description: Request state machine front end.                    */
/*-----------------------------------------------------------------------------  */
module vscale (aready_, bready_, veraren_, verbren_, memren_, imagwen_,
          clrhrowardy_, clrhrowbrdy_, memwe_, memdat[63:0],
          startadd[17:5], endadd[17:5], clrframecnt,
          dataouta[23:0], dataoutb[23:0],
          clraready_, clrbready_, hrowardy_, hrowbrdy_,
          onemode, loadmode_, vres[10:0], multreg[13:0],
          memrena_, memrenb_, imagwena_, imagwenb_, reset_,
          vclk1, vclk2, vclk3, vclk4, phase, sclk);
output    aready_, bready_, veraren_, verbren_, memren_, imagwen_,
     clrhrowardy_, clrhrowbrdy_, memwe_, clrframecnt;
output[63:0]          memdat;
output[17:5]          startadd, endadd;
input clraready_, clrbready_, hrowardy_, hrowbrdy_, onemode, loadmode_,
     memrena_, memrenb_, imagwena_, imagwenb_, reset_,
     vclk1, vclk2, vclk3, vclk4, phase, sclk;
input[23:0] dataouta, dataoutb;
input]13:0] multreg;
input[10:0] vres;
wire [23:0] nregl, preg1, nreg2, preg2, nreg3, preg3, nreg4, preg4,
     vdatreg1, vdatreg2, vdatreg3, vdatreg4;
wire [3:0] nvctrl, pvctrl;
wire [13:11]    mult;
wire [10:0] invert;
wire [7:0] vbufregc;
wire [15:0] vbufregb;
vextcnt vextcntlx(nreg1[23:0], preg1[23:0],
          dataouta[23:0], dataoutb[23:0], aprev, vclkl, sclk);
vextcnt vextcnt2x(nreg2[23:0], preg2[23:0],
          dataouta[23:0], dataoutb[23:0], aprev, vclk2, sclk);
vextcnt vextcnt3x(nreg3[23:0], preg3[23:0],
          dataouta[23:0], dataoutb[23:0], aprev, vclk3, sclk);
vextcnt vextcnt4x(nreg4[23:0], preg4[23:0],
          dataouta[23:0], dataoutb[23:0], aprev, vclk4, sclk);
vextrap vextraplx(vdatreg1[23:0],
          nreg1[23:0], preg1[23:0], nvctrl[3:0], pvctrl[3:0]);
vextrap vextrap2x(vdatreg2[23:0],
          nreg2[23:0], preg2[23:0], nvctrl[3:0], pvctrl[3:0]);
vextrap vextrap3x(vdatreg3[23:0],
          nreg3[23:0], preg3[23:0], nvctrl[3:0], pvctrl[3:0]);
vextrap vextrap4x(vdatreg4[23:0],
          nreg4[23:0], preg4[23:0], nvctrl[3:0], pvctrl[3:0]);
vrencon vrenconx(nvctrl[3:0], pvctrl[3:0], aready_, bready_,
          veraren_, verbren_, vwenable_, clrhrowardy_, clrhrowbrdy_,
          clrmult, incmult, clrframecnt, incrframecnt,
          vclrcnt, vincrcnt, incadder, decadder, aprev,
          vres[10], vcnt8, clraready_, clrbready_, hrowardy_,
          mult[13:11], hrowbrdy_, onemode, loadmode_, adder10,
          addgrt0, framecnt10, vclk4, sclk);
vrenadd vrenaddx(adder10, addgrt0,
          invert[10:0], vres[10:0], clrframecnt, incadder, decadder,
          onemode, phase, sclk);
vrfram vrframx(framecnt10, invert[10:0],
          vres[10:0], clrframecnt, incrframecnt, onemode, sclk);
vrmult vrmultx(mult[13:11],
          multreg[13:0], clrmult, incmult, onemode, sclk);
```

APPENDIX A-continued

```
vrstart vrstartx(startadd[17:5], endadd[17:5],
        invert[9:1]);
vrvcnt vrvcntx (vcnt8,
        vclrcnt, vincrcnt, sclk);
exttmcnt exttmcntx(memwe__, clkenl, clkenh, muxeq2, muxeq5, muxeg3,
muxeg6,
        muxeq4, muxeq7,
        vwenable__, reset__, vclk1, vclk4, sclk);
vdatreg vdatregx(vbufregc[7:0], vbufregb[15:0], memren__, imagwen__,
        vdatreg2[15:0], vdatreg3[7:0], memrena__, memrenb__,
        imagwena__, imagwenb__, sclk);
exttmeml exttmem1x(memdat[31:0],
        vdatregl[23:0], vdatreg3[23:0], vdatreg4[23:0],
        vbufregb[7:0], vbufregc[7:0], clkenl,
        muxeq2, muxeq3, muxeq6, sclk);
exttmem2 exttmem2x(memdat[63:32],
        vdatreg1[23:0], vdatreg2[23:0], vdatreg3[23:16],
        vdatreg4[23:0], vbufregb[15:8], clkenh,
        muxeq2, muxeq5, muxeq6, muxeq4, muxeq7, sclk);
endmodule
/*-----------------------------------------------------------------------------------------------------  */
/*   end of module: vscale                                                                                */
/*********************************************************************************************************  */
/*********************************************************************************************************  */
/*                    VDATREG Module                                                                      */
/*   functional description: Request state machine front end.                                             */
/*-----------------------------------------------------------------------------------------------------  */
module vdatreg (vbufregc, vbufregb, memren__, imagwen__,
        vdatreg2, vdatreg3, memrena__, memrenb__, imagwena__,
        imagwenb__, clk);
input memrena__, memrenb__, imagwena__, imagwenb__, clk;
input[15:0] vdatreq2;
input[7:0] vdatreg3;
output    memren__, imagwen__;
output [7:0] vbufregc;
output [15:0] vbufregb;
reg[7:0] vbufregc;
reg[15:0] vbufregb;
wire memren__ = memrena__ && memrenb__;
wire imagwen__ = imagwena__ && imagwenb__;
always @(posedge clk)
begin
    vbufregc[7:0] <= vdatreg3[7:00];
    vbufregb[15:0] <= vdatreg2[15:0];
end
endmodule
/*-----------------------------------------------------------------------------------------------------  */
/*    end of module: vdatreg                                                                              */
/*********************************************************************************************************  */
/*********************************************************************************************************  */
/*                    EXTTMCNT Module                                                                     */
/*   functional description: Request state machine front end.                                             */
/*-----------------------------------------------------------------------------------------------------  */
module exttmcnt (memwe__, clkenl, clkenh, muxeq2, muxeq5, muxeq3,
        muxeq6, muxeq4, muxeq7,
        vwenable__, reset__, vclk1, vclk4, clk);
input vwenable__, reset__, vclk1, vclk4, clk;
output    memwe__, clkenl, clkenh, muxeg2, muxeq5, muxeq3, muxeq6,
    muxeq4, muxeq7;
reg[2:0]    muxcnt;
reg d__clrmux, cirmux, d__incrmux, incrmux, d__state, state, memwe__,
    clkenl, clkenh, muxeq2, muxeq3, muxeq4, muxeq5, muxeq6,
    muxeq7, clkenwe;
parameter IDLE = 0;
parameter RUN = 1;
always @(posedge clk)
begin
    clrmux <= d__clrmux;
    incrmux <= d__incrmux;
end
always @(posedge clk or negedge reset__)
begin
    if (!reset__)
        state <= IDLE;
    else
        state <= d__state;
end
wire [2:0] muxcntpl = muxcnt[2:0] + 1;
always @(posedge clk)
```

APPENDIX A-continued

```
begin
    if (clrmux)
    begin
        muxcnt[2:0] <= 3'h0;
        clkenl <= 1;
        clkenh <= 0;
        clkenwe <= 0;
        muxeq2 <= 0;
        muxeq5 <= 0;
        muxeq3 <= 0;
        muxeq6 <= 0;
        muxeq4 <= 0;
        muxeq7 <= 0;
    end
    else if (incrmux)
    begin
        muxcnt[2:0] <= muxcntpl[2:0];
        clkenl <= (muxcnt[2:0] == 3'h7);
        clkenh <= (muxcnt[2:0] == 3'h0);
        clkenwe <= (muxcnt[2:0] == 3'hl) || (muxcnt[2:0] == 3'h4)
||
                    (muxcnt[2:0] == 3'h6);
        muxeq2 <= (muxcnt[2:0] == 3'h1):
        muxeq5 <= (muxcnt[2:0] == 3'h4);
        muxeq3 <= (muxcnt[2:0] == 3'h2);
        muxeq6 <= (muxcnt[2:0] == 3'h5);
        muxeq4 <= (muxcnt[2:0] == 3'h3);
        muxeq7 <= (muxcnt[2:0] == 3'h6);
    end
end
always @(posedge clk)
begin
    if (clkenwe)
        memwe_ <= 0;
    else
        memwe_ <= 1;
end
always @(state or incrmux or vwenable_ or vclk1 or vclk4 or clrmux or
    muxcnt)
begin
    d_state = state;
    d_incrmux = incrmnux;
    d_clrmux = clrmux;
case (state)    //synopsys parallel_case full_case
IDLE:
begin
    d_clrmux = 1;
    d_incrmux = 0;
    if (!vwenable_ && vclk1 && vclk4)
    begin
        d_state = RUN;
        d_incrmux = 1;
        d_clrmux = 0;
    end
end
RUN:
begin
    if (vwenable_ && vclk1 && vclk4 && muxcnt[2])
        d_state = IDLE;
end
endcase
end
endmodule
/*-------------------------------------------------------------------------------------------------------*/
/*   end of module: exttmcnt                                                                            */
/*****************************************************************************************************/
/*****************************************************************************************************/
/*                    EXTTMEM1 Module                                                                   */
/*   functional description: Request state machine front end.                                           */
/*-------------------------------------------------------------------------------------------------------*/
module exttmeml (memdat,
        vdatrega, vdatregc, vdatregd, vbufregb, vbufregc, clkeni,
        muxeq2, muxeq3, muxeq6, clk);
input clkenl, muxeq2, muxeq3, muxeq6, clk;
input[23:0] vdatrega, vdatregc, vdatregd;
input[7:0] vbufregb, vbufregc;
output[31:0]    memdat;
reg[31:0]    memdat;
always @(posedge clk)
```

APPENDIX A-continued

```
begin
    if (clkenl)
        memdat[31:8] <= vdatrega[23:0];
    if (muxeq2)
        memdat[7:0] <= vdatregc[15:8];
    if (muxeq3)
    begin
        memdat[7:0] <= vbufregc[7:0];
        memdatf[31:8] <= vdatregd[23:0];
    end
    if (muxeq6)
    begin
        memdat[7:0] <= vbufregb[7:0];
        memdat[31:8] <= vdatregc[23:0];
    end
end
endmodule
/*-----------------------------------------------------------------------------------------------------------  */
/*   end of module: exttmem1.                                                                                  */
/*****************************************************************************************************************  */
/*****************************************************************************************************************  */
/*                    EXTTMEM2 Module                                                                          */
/*   functional description: Request state machine front end.                                                  */
/*-----------------------------------------------------------------------------------------------------------  */
/*                                                                                                              */
module exttmem2 (memdat,
        vdatrega, vdatregb, vdatregc, vdatregd, vbufregb, clkenh,
        muxeq2, muxeq5, muxeq6, muxeq4, muxeq7, clk);
input clkenh, muxeq2, muxeq5, muxeq6, muxeq4, muxeq7, clk;
input[23:0] vdatrega, vdatregb, vdatregd;
input[23:16] vdatregc;
input[15:8] vbufregb;
output[63:32]    memdat;
reg[63:32]    memdat;
always @(posedge clk)
begin
    if (clkenh)
        memdat[63:40] <= vdatregb[23:0];
    if (muxeq4)
        memdat[63:40] <= vdatrega[23:0];
    if (muxeq7)
        memdat[63:40] <= vdatregd[23:0];
    if (muxeq2)
        memdat[39:32] <= vdatregc[23:16];
    if (muxeq5)
        memdat[39:32] <= vdatregb[23:16];
    if (muxeq6)
        memdat[39:32] <= vbufregb[15:8];
end
endmodule
/*-----------------------------------------------------------------------------------------------------------  */
/*   end of module: exttmem2                                                                                   */
/*****************************************************************************************************************  */
```

What is claimed is:

1. A method of storing a plurality of x-bit data values into a plurality of y-bit words of memory, wherein x and y are integer values and x<y, the method comprising the steps of:

dividing at least one of the x-bit data values into z-bit sub-portions, wherein z is an integer value, and z<x; and storing a combination of undivided x-bit data values and z-bit sub-portions within each y-bit word such that at least one of the y-bit words is completely filled.

2. The method of claim 1, wherein each x-bit data value comprises a 24-bit data value.

3. The method of claim 2, wherein the dividing step comprises dividing at least one of the 24-bit data values into three 8-bit sub-portions.

4. The method of claim 3, wherein each y-bit word of memory comprises a quad word of memory, and wherein the storing step comprises storing a combination of undivided 24-bit data values and 8-bit sub-portions within each quad word of memory such that eight 24-bit data values are stored within three quad words of memory.

5. The method of claim 4, wherein the storing step comprises storing two undivided 24-bit values and two 8-bit sub-portions in each quad word of memory.

6. The method of claim 5, wherein each of the two 8-bit sub-portions stored within each quad word are stored on a double word boundary.

7. The method of claim 5, wherein the two undivided 24-bit data values stored within each quad word are each stored on a respective upper boundary of each double word of each quad word.

8. The method of claim 4, wherein the eight 24-bit data values are transmitted through four 24-bit pipes, and wherein the four 24-bit pipes are coupled to multiplexing hardware which provides for storage within one of the quad words of memory.

9. The method of claim 8, wherein the four 24-bit pipes are provided asynchronously.

10. A method of storing a plurality of x-bit pixels into a plurality of y-bit words of memory, wherein x and y are integer values and x<y, the method comprising the steps of:

dividing at least one of the x-bit pixels into z-bit sub-portions, wherein z is an integer value and z<x; and storing a combination of undivided x-bit pixels and z-bit sub-portions within each y-bit word such that at least one of the y-bit words is completely filled.

11. The method of claim 10, wherein each x-bit pixel comprises a 24-bit pixel.

12. The method of claim 11, wherein the dividing step comprises dividing at least one of the 24-bit pixels into three 8-bit representations of spectral components of the at least one 24-bit pixel.

13. The method of claim 12, wherein each y-bit word of memory comprises a quad word of memory, and wherein the storing step comprises storing a combination of undivided 24-bit pixels and 8-bit representations within each quad word of memory such that eight 24-bit pixels are stored within three quad words of memory.

14. The method of claim 12, wherein the three 8-bit representations comprise 8-bit representations of red, green and blue spectral components.

15. A method of storing a plurality of x-bit pixels into a plurality of y-bit words of memory, wherein x and y are integer values and x<y, the method comprising the steps of:

dividing at least one of the x-bit pixels into first, second and third z-bit representations of first, second and third spectral components of the at least one x-bit pixel, respectively, wherein z is an integer value and x=3z; and storing a combination of undivided x-bit pixels and z-bit representations within each y-bit word such that at least one of the y-bit words is completely filled.

16. The method of claim 15, wherein the first, second and third spectral components comprise red, green and blue spectral components.

17. The method of claim 15, wherein each x-bit pixel comprises a 24-bit pixel, and each z-bit representation comprises an 8-bit representation.

18. The method of claim 17, wherein each y-bit word of memory comprises a quad word of memory, and wherein the storing step comprises storing a combination of undivided 24-bit pixels and 8-bit representations within each quad word of memory such that eight 24-bit pixels are stored within three quad words of memory.

19. A display controller with the capability of storing a plurality of x-bit pixels into a plurality of y-bit words of memory, wherein x and y are integer values and x<y, the display controller comprising:

logic for dividing at least one of the x-bit pixels into z-bit representations of spectral components of the at least one x-bit pixel, wherein z is an integer value and z<x; and logic for storing a combination of undivided x-bit pixels and z-bit representations within each y-bit word such that at least one of the y-bit words is completely filled.

20. The display controller of claim 19, wherein each x-bit pixel comprises a 24-bit pixel.

21. The display controller of claim 20, wherein at least one of the 24-bit pixels is divided step into three 8-bit representations of spectral components of the at least one 24-bit pixel.

22. The display controller of claim 21, wherein each y-bit word of memory comprises a quad word of memory, and wherein a combination of undivided 24-bit pixels and 8-bit representations are stored within each quad word of memory such that eight 24-bit pixels are stored within three quad words of memory.

23. The display controller of claim 21, wherein the three 8-bit representations comprise 8-bit representations of red, green and blue spectral components.

24. A computer system with the capability of storing a plurality of x-bit pixels into a plurality of y-bit words of memory, wherein x and y are integer values and x<y, the display controller comprising:

a bus;

a processor coupled to the bus; and a display controller coupled to the bus, the display controller comprising:

logic for dividing at least one of the x-bit pixels into z-bit representations of spectral components of the at least one x-bit pixel, wherein z is an integer value and z<x, and logic for storing a combination of undivided x-bit pixels and z-bit representations within each y-bit word such that at least one of the y-bit words is completely filled.

25. The computer system of claim 24, wherein each x-bit pixel comprises a 24-bit pixel.

26. The computer system of claim 25, wherein at least one of the 24-bit pixels is divided step into three 8-bit representations of spectral components of the at least one 24-bit pixel.

27. The computer system of claim 26, wherein each y-bit word of memory comprises a quad word of memory, and wherein a combination of undivided 24-bit pixels and 8-bit representations are stored within each quad word of memory such that eight 24-bit pixels are stored within three quad words of memory.

28. The computer system of claim 26, wherein the three 8-bit representations comprise 8-bit representations of red, green and blue spectral components.

29. A display with the capability of storing a plurality of x-bit pixels into a plurality of y-bit words of memory, wherein x and y are integer values and x<y, the display controller comprising:

a display screen; and a display controller, the display controller comprising:

logic for dividing at least one of the x-bit pixels into z-bit representations of spectral components of the at least one x-bit pixel, wherein z is an integer value and z<x, and logic for storing a combination of undivided x-bit pixels and z-bit representations within each y-bit word such that at least one of the y-bit words is completely filled.

30. The display of claim 29, wherein each x-bit pixel comprises a 24-bit pixel.

31. The display of claim 30, wherein at least one of the 24-bit pixels is divided step into three 8-bit representations of spectral components of the at least one 24-bit pixel.

32. The display of claim 31, wherein each y-bit word of memory comprises a quad word of memory, and wherein a combination of undivided 24-bit pixels and 8-bit representations are stored within each quad word of memory such that eight 24-bit pixels are stored within three quad words of memory.

33. The display of claim 31, wherein the three 8-bit representations comprise 8-bit representations of red, green and blue spectral components.

* * * * *